United States Patent [19]

Kimmelshue

[11] Patent Number: 4,816,048

[45] Date of Patent: Mar. 28, 1989

[54] QUICK COOLING INSERT

[76] Inventor: Michael J. Kimmelshue, 108 Whippoorwill Rd., Lufkin, Tex. 75901

[21] Appl. No.: 78,817

[22] Filed: Jul. 28, 1987

[51] Int. Cl.[4] ..... F25D 5/02

[52] U.S. Cl. ..... 62/4; 62/293; 126/263

[58] Field of Search ..... 62/4, 293, 371, 372; 126/263; 206/222

[56] References Cited

U.S. PATENT DOCUMENTS

| | | | |
|---|---|---|---|
| 1,303,618 | 5/1919 | Turrettini | 126/263 |
| 1,689,578 | 10/1928 | Benz | 62/4 X |
| 2,289,008 | 7/1942 | Gessler | 62/4 X |
| 2,746,265 | 5/1956 | Mills | 62/4 |
| 3,003,324 | 10/1961 | Vance et al. | 62/4 |
| 3,369,369 | 2/1968 | Weiss | 62/4 |
| 3,379,025 | 4/1968 | Donnelly | 62/4 |
| 3,970,068 | 7/1976 | Sato | 62/4 X |
| 4,002,235 | 1/1977 | Donnelly | 62/4 X |

*Primary Examiner*—William E. Tapolcai

*Attorney, Agent, or Firm*—Leon Gilden

[57] ABSTRACT

A specially designed beverage container includes a centrally disposed conduit containing two separate reactants. The reactants are separated by a plastic membrane, and the membrane may be manually ruptured to effect a mixing of the reactants. The reactants, which comprise ammonium nitrate and distilled water, produce an endothermic reaction when mixed which in turn results in a rapid cooling of the beverage retained within the container.

6 Claims, 1 Drawing Sheet

QUICK COOLING INSERT

BACKGROUND OF THE INVENTION

1. Field of the Invention

The present invention relates to cooling devices, and more particularly pertains to a new and improved device for quickly cooling fluid or solid foodstuffs retained within a container.

2. Description of the Prior Art

Disposable devices for rapid cooling of drinks or foodstuffs by an endothermic reaction are well known in the prior art. For example, U.S. Pat. No. 4,528,218, which issued to C. Maione on July 9, 1985, discloses a disposable device for cooling drinks and other food stuffs wherein such device utilizes solid and liquid reactants separated by a rupturable diaphragm. Manual pressure may be utilized to rupture the diaphragm and thus cause a mixing of the reactants to initiate the endothermic reaction. While being functional for its intended purpose, the Maione device is separately attachable by the user to the foodstuff or fluid to be cooled. As can be appreciated, this is an inconvenient and time consuming process, and in many instances, a cooling device would not be readily available for use. As such, there would appear to be a continuing need for some new and improved type of quick cooling apparatus for a foodstuff or fluid beverage wherein the same would be permanently attached to the particular food or fluid to be cooled and in this respect, the present invention addresses this need.

SUMMARY OF THE INVENTION

In view of the foregoing disadvantages inherent in the known types of quick cooling devices now present in the prior art, the present invention provides an improved quick cooling apparatus wherein the same is permanently installed within a fluid beverage container and is readily actuated by a user when needed. As such, the general purpose of the present invention, which will be described subsequently in greater detail, is to provide a new and improved quick cooling arrangement which has all the advantages of the prior art quick cooling apparatuses and none of the disadvantages.

To attain this, the present invention envisions a modified metallic beverage container, such as a conventional aluminum can or the like, which includes a substantially sealed centrally disposed conduit for holding reactants. The enclosed conduit is provided with a plastic membrane along a midportion thereof, and the membrane separates two reactants, e.g., ammonium nitrate and distilled water, retained within the conduit. In the preferred embodiment, the ammonium nitrate is retained within a tubular member slidedly disposed within the conduit and having an open end disposed against the aforementioned plastic membrane. When a user of the container removes the "pop top", a drinking aperture is formed for access to the retained beverage and additionally, the conduit is exposed whereby the user can manually move the ammonium nitrate holder downwardly within the conduit to effect a rupturing of the membrane. Upon a mixing of the ammonium nitrate with the distilled water, an endothermic reaction is created which results in a rapid cooling of the beverage prior to its consumption.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constuctions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage cooling device which has all the advantages of the prior art beverage cooling devices and none of the disadvantages.

It is another object of the present invention to provide a new and improved beverage cooling device which may be easily and efficiently manufactured and marketed.

It is a further object of the present invention to provide a new and improved beverage cooling device which is of a durable and reliable construction.

An even further object of the present invention is to provide a new and improved beverage cooling device which is susceptible of a low cost of manufacture with regard to both materials and labor, and which accordingly is then susceptible of low prices of sale to the consuming public, thereby making such beverage cooling devices economically available to the buying public.

Still yet another object of the present invention is to provide a new and improved beverage cooling device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
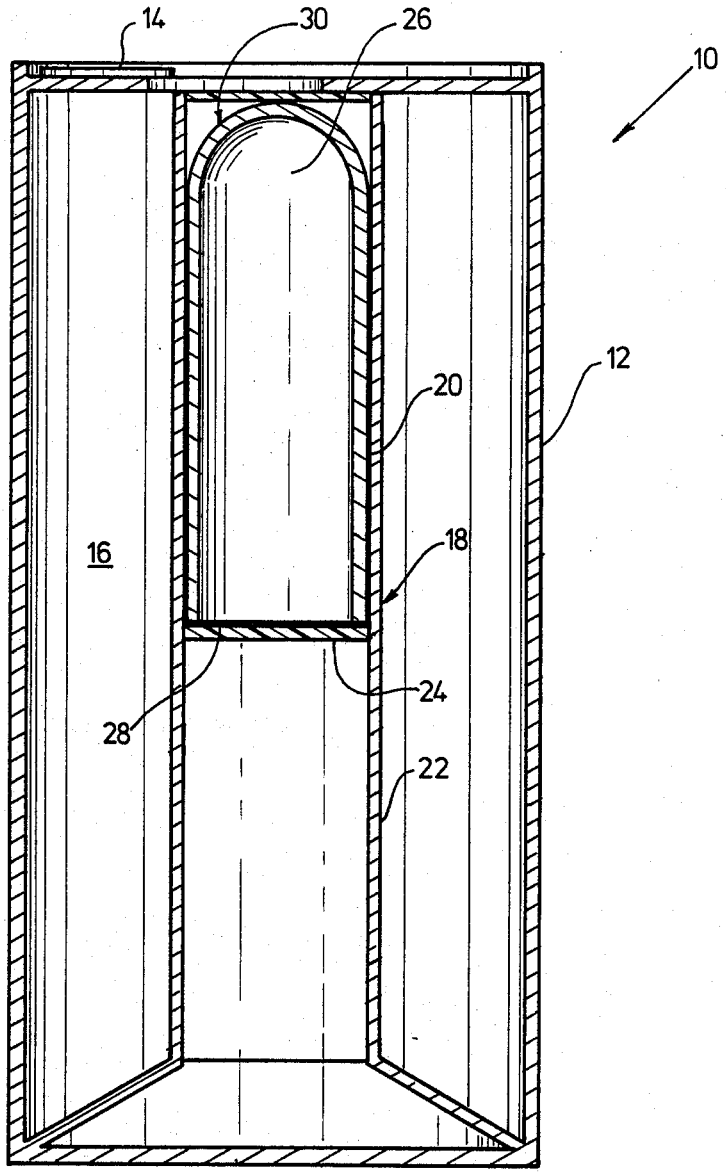
FIG. 1 is a diagrammatic side elevation view of the invention.

With reference now to the single drawing in the application, a new and improved rapid cooling device for a beverage or other food stuff embodying the principles and concepts of the present invention and generally designated by the reference numeral 10 will be described.

More specifically, it will be noted that the invention 10 in a preferred embodiment includes a cylindrically shaped beverage container 12, such as an aluminum can or the like, having a manually removable "pop top" 14 for achieving access to a retained beverage 16 in a well known manner. Symmetrically disposed along an axial length of the container 12 is a sealed conduit 18. The conduit 18 is divided into two compartments 20, 22 which are separated by a impermeable plastic membrane 24. The compartments 20, 22 are designed to hold reactants which, when mixed together, will result in an endothermic reaction to accomplish a rapid cooling the beverage 16 retained within the container 12. More specifically, the compartment 22 is filled with distilled water which comprises a first reactant utilizable in the desired endothermic reaction. By the same token, the compartment 20 has a small tubular member 26 slidably disposed therein with this member extending along substantially the entire length of the compartment so as to abut against a top surface of the plastic membrane 24 and also against a bottom surface of the removable closure 14. The tubular member 26 has a bottom end portion 28 open and is filled with ammonium nitrate which comprises the second reactant needed to achieve the desired endothermic reaction.

With respect to the manner of usage and operation of the present invention, it can be appreciated that when it is desired to rapidly cool the beverage 16, a user must first remove the closure 14 from the container 12. Once the closure 14 has been removed, a further flexible diaphragm 30 is exposed which overlies a top portion of the reactant holder 26. In a preferred embodiment, the diaphragm 30 would comprise a rubber seal. To effect the desired cooling of the beverage 16, a user need only to press downwardly against the diaphragm 30 which in turn results in a slidable movement of the holder 26 against the plastic membrane 24. As the user increases pressure, the membrane 24 will rupture which results in a mixing together of the ammonium nitrate and distilled water. As is well known in the art, the mixing of ammonium nitrate in distilled water will result in a rapid endothermic reaction, thus to achieve the desired cooling of the beverage 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved rapid cooling arrangement for a food stuff, said arrangement comprising, food holding container means;

reactant holding chamber means defining a conduit fixedly secured to said holding container means;

first reactant means retained within a first compartment means defined within said reactant holding chamber means;

second reactant means retained within a second compartment means defined within said reactant holding chamber means; and a first flexible diaphragm means separating said first and second compartment means, said first diaphragm means being rupturable to permit a mixing of said first and second reactant means and extending completely across said reactant holding chamber means, thereby to achieve an endothermic reaction to effect a rapid cooling of said food stuff, and closure means forming a part of said food holding container means, said closure means facilitating an access to said food stuff by a user, and an elongate open ended tubular reactant holder means, said reactant holder means being retained within said first compartment means between said closure means said said first diaphragm means, said reactant holder means contained therein and slidably mounted within said first compartment means, with the open end of said reactant holder means in confronting relationship to said first diaphragm means, to rupture said first diaphragm means upon application of pressure to said reactant holder means, and a second flexible diaphragm means fixedly secured overlying said first compartment to sealing contain said endothermic reaction within said reactant holding chamber means.

2. A new and improved rapid cooling arrangement for a food stuff as described in claim 1, wherein said food holding container means comprises a beverage container.

3. A new and improved rapid cooling arrangement for a food stuff as described in claim 2, wherein said beverage container comprises a cylindrically shaped metallic can.

4. A new and improved rapid cooling arrangement for a food stuff as described in claim 3, wherein said reactant holding chamber means is centrally disposed within said can.

5. A new and improved rapid cooling arrangement for a food stuff as described in claim 4, wherein said food holding container means comprises a beverage can.

6. A new and improved rapid cooling arrangement for a food stuff as described in claim 5, wherein said reactant holding chamber means is centrally disposed within said beverage can and is integrally attached thereto.

* * * * *